US005519969A

United States Patent [19]

Golba

[11] Patent Number: 5,519,969

[45] Date of Patent: May 28, 1996

[54] REMOVABLE ROOF FLASHING COVER SYSTEM

[76] Inventor: Thomas R. Golba, 6390 Teal Rd., Petersburg, Mich. 49270

[21] Appl. No.: 155,409

[22] Filed: Nov. 19, 1993

Related U.S. Application Data

[63] Continuation-in-part of Ser. No. 746,881, Aug. 19, 1991, abandoned.

[51] Int. Cl.[6] ..... E04D 13/147; E04D 13/14

[52] U.S. Cl. ..... 52/60; 52/58; 52/94

[58] Field of Search ..... 52/58, 60, 94, 52/539

[56] References Cited

U.S. PATENT DOCUMENTS

| | | | |
|---|---|---|---|
| 801,154 | 10/1905 | Pioch . | |
| 1,685,525 | 9/1928 | Dow . | |
| 1,694,521 | 12/1928 | Tucker . | |
| 1,804,315 | 5/1931 | Budd . | |
| 1,860,240 | 5/1932 | Friedrich | 52/60 |
| 1,886,462 | 11/1932 | Bever | 52/60 |
| 1,942,137 | 1/1934 | Connell | 247/3 |
| 1,958,622 | 5/1934 | Herman | 52/60 |
| 2,274,647 | 3/1942 | Avard | 108/26 |
| 2,360,031 | 10/1944 | Andrews | 52/58 |
| 2,702,514 | 2/1955 | Dalley | 108/26 |
| 2,995,870 | 8/1961 | O'Hanlon | 50/47 |
| 3,172,236 | 3/1965 | Weckerly | 50/43 |
| 3,237,352 | 3/1966 | Edwards | 52/60 |
| 3,241,271 | 3/1966 | Berg | 52/58 |
| 3,256,650 | 6/1966 | Weckerly et al. | 52/58 |
| 3,410,038 | 11/1968 | Gobel | 52/62 |
| 3,667,177 | 6/1972 | Biela | 52/278 |
| 4,037,372 | 7/1977 | Patry | 13/14 |
| 4,165,577 | 8/1979 | Shanahan | 43/112 |
| 4,461,128 | 7/1984 | Knoebl | 52/94 |
| 4,462,190 | 7/1984 | Allen | 52/58 |
| 5,123,208 | 6/1992 | Kirby et al. | 52/58 |

FOREIGN PATENT DOCUMENTS

| | | | |
|---|---|---|---|
| 1026076 | 2/1978 | Canada | 52/58 |
| 2110312 | 9/1972 | Germany | 52/288 MF |
| 3-224941 | 10/1991 | Japan | 52/58 |

*Primary Examiner*—Carl D. Friedman
*Assistant Examiner*—Kevin D. Wilkens
*Attorney, Agent, or Firm*—Donald R. Bahr

[57] ABSTRACT

A removable roof flashing cover system for use on structures which are faced with siding, such as aluminum or vinyl siding. By use of this invention, the space between the terminal edge of the siding and roof line can be compensated for during the initial installation or at a subsequent point in time. This invention is particularly useful in compensating for spaces or gaps which may occur in the roof line as a result of reroofing. The composite assembly consists of a channel, a wall bracket, and a removable face panel. The channel and the wall bracket are secured to a vertical building surface. The removable face panel is secured between the channel and wall bracket. When the system of this invention is utilized, a building which is covered with siding can be easily reflashed during a reroofing operation. It is preferred that the channel be J-shaped.

27 Claims, 3 Drawing Sheets

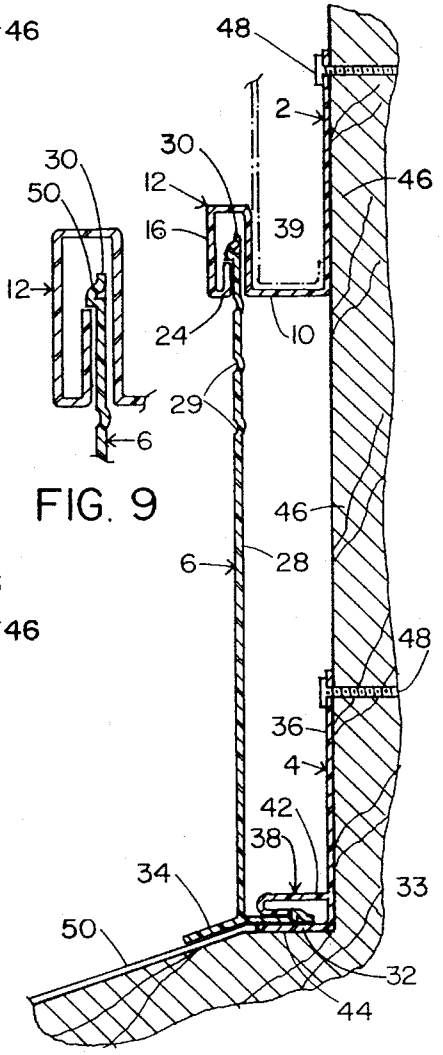
FIG. 8
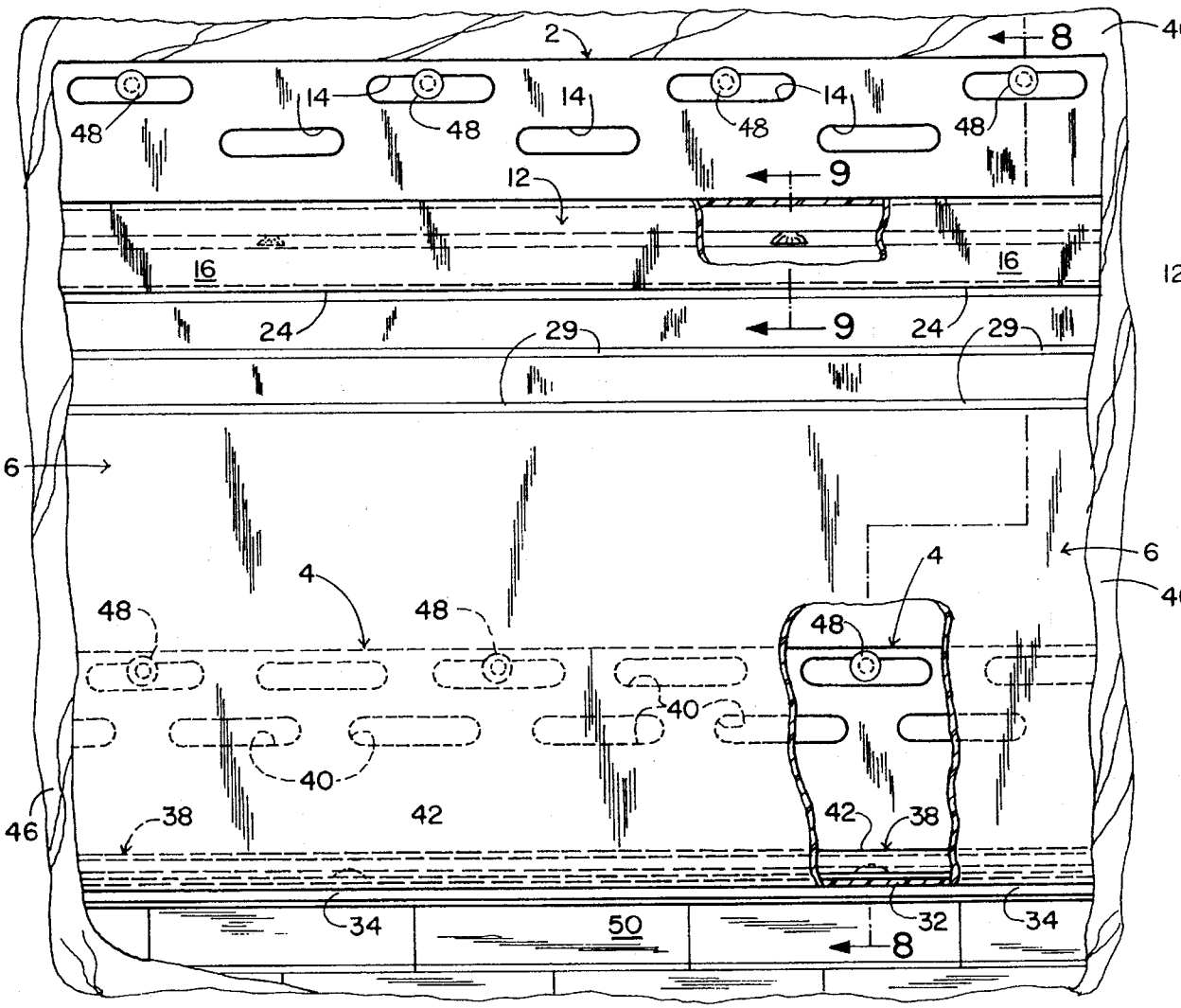
FIG. 9
FIG. 7

REMOVABLE ROOF FLASHING COVER SYSTEM

RELATED APPLICATIONS

This application is a continuation in part application of application Ser. No. 07/746,881 filed Aug. 19, 1991, now abandoned.

BACKGROUND OF THE INVENTION

1. Field of the Invention

This invention is concerned with a removable roof flashing cover system which is useful with replacement siding as is commonly used on older structures. When the removable roof flashing cover system of this invention is used, upon application of the siding, it is possible at a later date to alter the depth of the flashing panel in order to compensate for gaps which may have resulted because the adjacent roofing has been replaced and to further permit proper flashing of the new roof. This invention is particularly useful when structures covered with vinyl and aluminum siding are reroofed.

2. Description of the Prior Art

The problem of how to seal and make waterproof or water resistant vertical and horizontal building surfaces is as old as the building trades. In its most rudimentary fashions, this problem was solved by the blending and sealing of the vertical and horizontal surfaces with sheet metal such as sheet copper, aluminum or lead. The sealing of the sheet metal component to the respective surfaces was effected with a mastic such as tar. This method of sealing building surfaces is still commonly used.

In the past few decades, a new form of building renewal has come into wide spread use namely the trade of applying interlocking siding to the vertical surfaces of buildings in order to give these surfaces a new appearance. In this regard, the application of interlocking panels of vinyl and aluminum siding to older structures has become quite common. Since this siding is often applied to older structures, a problem has arisen as to how to flash the vertical siding to the horizontal roofing surfaces. The situation is further complicated by the fact that the roofing on the structure is likewise often replaced at intervals of fifteen to twenty-five years. With a life expectancy of a structure of one hundred years, multiple applications of roofing are possible.

As multiple layers of roofing are applied, the thickness and the weight of the roofing increases. Because of the weight increase, building codes often only permit three reroofings to occur before all the roofing must be removed prior to the application of new roofing. The old roofing must be removed because of its weight in order to prevent structural failure of the building. That is, building codes often permit, for example, a homeowner to have his house reroofed three times before he must remove all roofing material. A layer of roofing is between ⅜ and ¾ inches, therefore, three layers as may be applied over a period of years, can represent a thickness of between 1⅛ and 2¼ inches to the thickness of the added roofing must be added to the thickness of the original roofing which can be up to 1 inch.

When replacement siding is applied, it is often applied to structures which have been reroofed multiple times, hence, the siding must abut up to a layer of roofing which may be ⅜ to 3¼ inches above the base of the roof. If it is necessary to reroof the structure after siding has been applied, the building code may require that all the roofing be removed thereby creating a substantial gap between the new roofing and the siding. In prior art siding techniques, there was no way this unsightly gap could be covered up using a component part which is integral with the siding. In the prior art, this problem was most often resolved by the roofer via the liberal application of tar to the resulting gap. From an aesthetic point of view, this application of tar created an unsightly mess. Further, in the prior art there is no way that the first course of siding could be easily removed to permit a new roof to be reflashed.

In accordance with this invention, when a new roof is applied to a structure which has been previously sided with vinyl or aluminum siding, the roofer can remove the flashing cover and replace it with a flashing cover of a different depth so as to fill in any gaps which are created as a result of the removal of multiple layers of old roofing. Further, the new roof can be easily reflashed.

The prior art has addressed many forms of roof flashing as is illustrated by U.S. Pat. Nos. 1,685,525; 1,694,514; 2,274,647; 2995,870; 3,172,236; 3,410,038 and 4,462,190. While a diverse number of roof flashing problems are addressed in these prior art patents, the disclosures of these patents fail to address the problems as discussed above relative to replacement roofs and structures which are sided with vinyl or aluminum siding.

Further, none of this prior art suggests the present inventive combination of component elements arranged and configured for the efficient solution of this problem as disclosed and claimed herein. Prior devices do not provide the benefits of the present invention which achieves its intended purposes, objectives and advantages over the prior art devices through a new, useful and unobvious combination of component elements, through no increase in the number of functioning parts, at a minimum cost and through the utilization of only readily available materials and conventional components.

Therefore, it is an object of the present invention to provide a removable roof flashing cover system wherein the flashing cover can be of more than one height.

It is a further object of this invention to provide a roof flashing cover system wherein any gap which is created by the removal and replacement of roofing can be compensated for.

Another objective is to provide a siding system wherein the flashing cover of siding can be easily removed thereby permitting the reflashing of the roof during a reroofing operation.

It is yet another objective of this invention to provide a roof flashing cover system which is particularity suitable for use with vinyl and aluminum siding.

Lastly, it is an object of this invention to provide a removable roof flashing cover system wherein face panels of different heights can be readily removed and replaced on previously applied siding.

These objects and advantages should be construed as merely illustrative of some of the more prominent features and applications of this invention. Many other beneficial results can be obtained by applying the disclosed invention in a different manner or by modifying the invention within the scope of the disclosure. Accordingly, other objects and advantages as well as a fuller understanding of the invention may be had by referring to the summary and detailed description of the preferred embodiment of the invention in addition to the scope of the invention as defined by the claims taken in conjunction with the accompanying drawings.

SUMMARY OF THE INVENTION

The present inventions defined by the appended claims with the specific preferred embodiment shown in the attached drawings. For the purposes of summarizing the invention, the invention may be used with many types of siding as is commonly used on residential and other structures. The present invention may be used with original or replacement siding.

The subject invention uses three component parts which cooperate with each other in order to form a composite removable flashing cover system. These component parts cooperate with standard siding. The first component of the removable roof flashing cover system of this invention is a wall bracket. The second component is a J-channel which is positioned over the wall bracket and which is adapted to receive the cut end edges or butt edges of the siding. Both the wall bracket and the J-channel incorporates a means for receiving and securing in place a snap in place face panel. It is this latter mentioned snap in face panel which can be varied in height in order to compensate for gaps between the siding and the roofing. During reroofing, the face panel can be removed to permit the new roof to be properly reflashed.

The forgoing has outlined rather broadly the more pertinent and important features of the present invention in order that the detailed description of the invention that follows may be better understood whereby the present contribution to the art may be fully appreciated. Additional features of the invention will be described hereinafter which form the subject of the claims of the present invention. It should be appreciated by those skilled in the art that the conception and the specific embodiment inclosed hereinwith may be readily utilized as a basis for modifying or designing other apparatus for carrying out the same purposes of the present invention. It should also be realized by those skilled in the art that such equivalent apparatus does not depart from the spirit and scope of the invention as set forth in the appended claims.

BRIEF DESCRIPTION OF THE DRAWINGS

For a more complete understanding of the nature, objects and advantages of the present invention, reference should be had to the following detailed description taken in conjunction with the accompanying drawings in which:

FIG. 7 is a fragmentary front elevational view, partially shown in section, showing the removable roof flashing cover system assembled to a structure;

FIG. 8 is a fragmentary vertical section view through the assembly, taken on the staggered section line 8—8 of FIG. 7;

FIG. 9 is an enlarged fragmentary vertical sectional view, showing the connection between the J-channel and the upper part of the removable face panel;

DETAILED DESCRIPTION OF THE INVENTION

From FIGS. 1 to 14, it can be seen that the removable roof flashing cover system of this invention consist of three major parts, these parts being a J-channel 2, a wall bracket 4, and a removable face panel 6.

Figure 1:
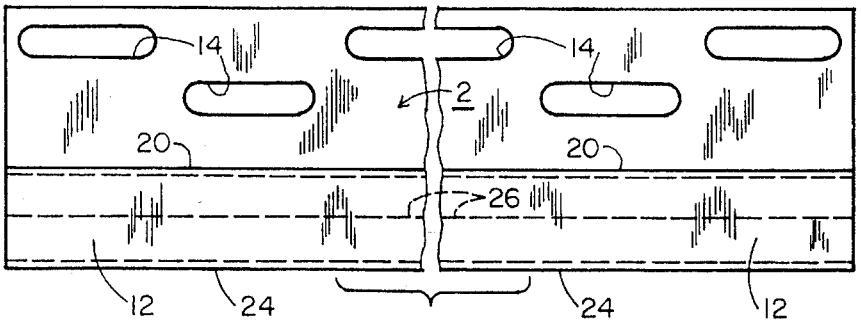
FIG. 1 is a fragmentary front elevational view of the J-channel for the removable roof flashing cover system.
Figure 2:
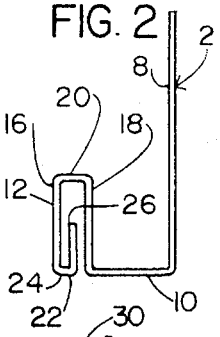
FIG. 2 is an end elevational view of an alternate J-channel.

FIGS. 1 and 2 are end and side views of J-channel 2. This channel incorporates a main body portion 8, a byte portion 10, and a locking means 12. J-channel further incorporates a plurality of nailing slots 14 wherein J-channel 2 is nailed to the side of the structure to which siding is being applied. Locking means 12 is formed from a U-shaped channel which is formed by side members 16 and 18 and a byte member 20. Locking means 12 further incorporates a reverse bend portion 22 which is formed by a byte member 24 and a locking leg 26.

Figure 14:
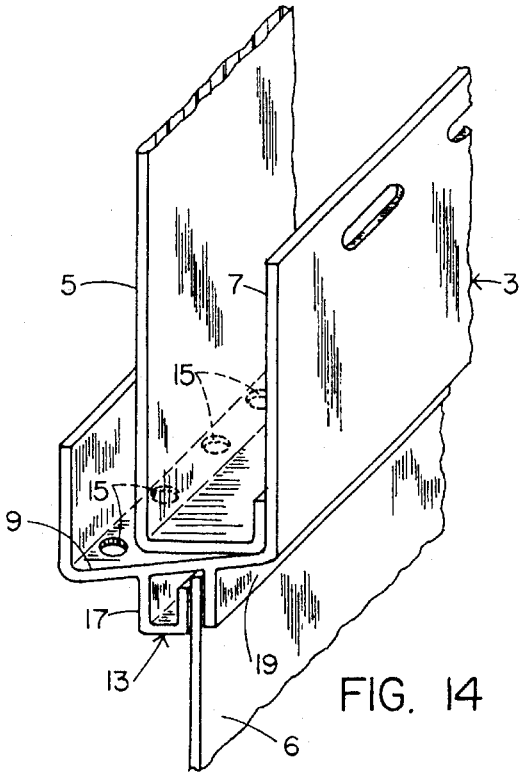
FIG. 14 is an enlarged fragmentary end elevated view of an alternate J-channel.

An alternate J-channel 3, as is illustrated in FIG. 14 is useful in environments where water or ice may be a problem. As can be seen, alternate J-channel 3 incorporates the main body portion 7, a byte portion 9, and locking means 13. Significantly in this structure, it can be seen that the angle between the byte portion 9 and main body portion 7 is greater than 90 degrees. As a result of the fact that the angle between byte portion 9 and main portion 7 is greater than 90 degrees, byte portion 9 generally slopes away from the main body portion 7 and hence, away from the wall of the structure to which the J-channel 3 is attached. As a result of this slope, any water which may gather in J-channel 3 is funneled away from the structure and egresses J-channel 3 through a plurality of apertures 15. It is preferred that apertures 15 be placed on the outer edge of byte portion 9 away from the supporting structure. Locking means 13 comprises a J shaped leg 17 and a I shaped leg 19.

It has been found that the satisfactory angle for the angle between the byte portion and the main body portion 7 is between 93 and 100 degrees. This slight angle will allow the byte portion 9 to receive and retain the lower edge of siding in a satisfactory manner and yet water and moisture is channelled away from the structure to which J-channel 3 is attached and to which the siding 5 is attached. The positioning of siding 5 in a J-channel is illustrated in FIG. 8. As can be seen locking means 13 is positioned midpoint on byte position 9 and most significantly behind apertures 15. This arrangement prevents water, which egresses through apertures 15, from being trapped behind face panel 6. Instead water which egresses through apertures 15 drops to the roofline and is transferred away through the gutter system of the structure.

The alternate J-channel, as illustrated in FIG. 14, allows water to drain away from the flashing rather than draining behind the flashing. Further, as a result of the fact that water immediately egresses J-channel 3, there is no damaging buildup of ice which could plug apertures 15 and/or causes shifting of siding 5 in relation to the J-channel.

Figure 3:
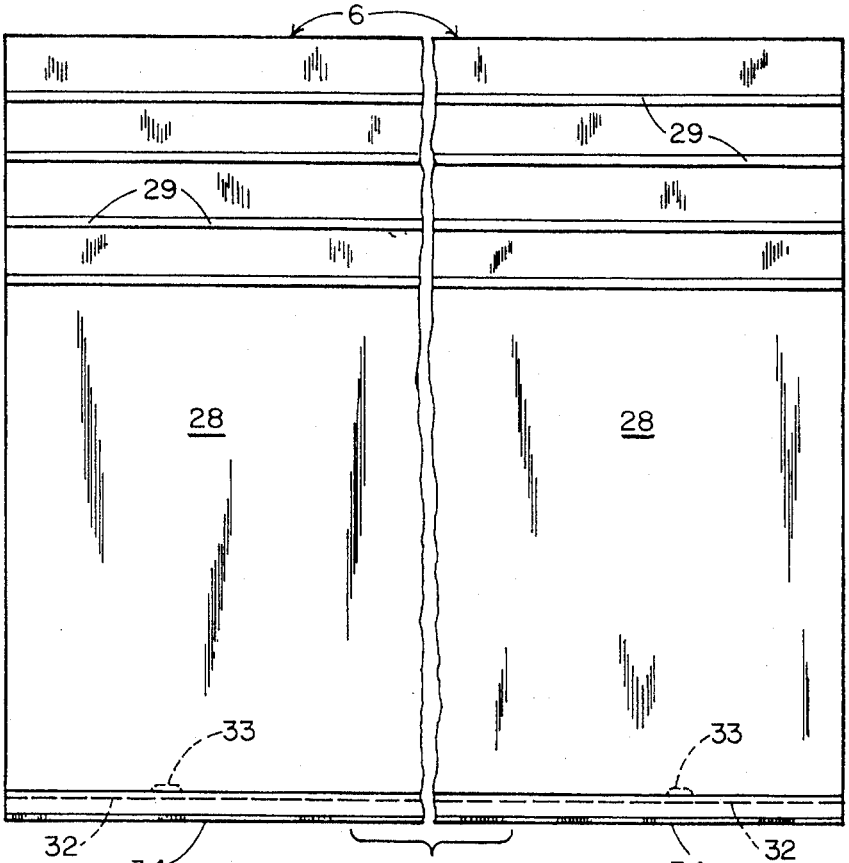
FIG. 3 is a fragmentary front elevational view of the removable face panel.
Figure 4:
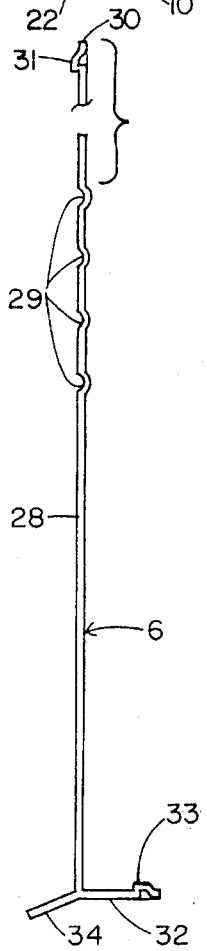
FIG. 4 is an end elevational view of the removable face panel of FIG. 3, the phantom lines indicate how the face panel may be trimmed to a desired height.

FIGS. 3 and 4 illustrate the details of removable face panel 6. Removable face panel 6 has a main body section 28 which terminates in end 30. The bottom edge of face panel 6 further includes a locking flange 34. The terminal end of flange 32 further incorporates a barb 33 which is adapted to engage locking means 38 of wall bracket 4.

Face panel 6 further incorporates a plurality of transverse scores 29. These scores permit the easy adjustment of the height of face panel 6. This height adjustment is accomplished in the following manner. When the face panel is to be replaced, the tradesman need only to select the proper height at the appropriate score 29. Once this is selected, face panel 6 need only be trimmed at the appropriate score line 29. Upon trimming, the terminal end of face panel 6 is then crimped and inserted into J-channel 2 and wall bracket 4.

Figure 5:
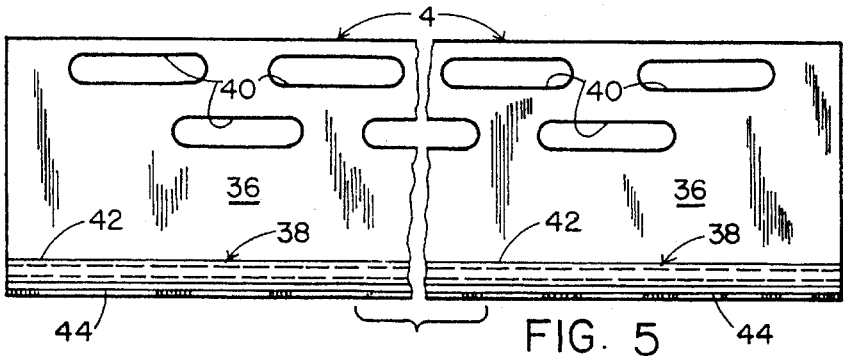
FIG. 5 is a fragmentary front elevational view of the wall bracket.
Figure 6:
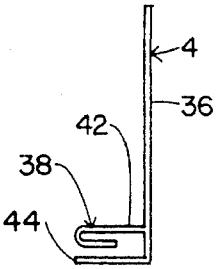
FIG. 6 is an end elevational view of the wall bracket of FIG. 5.

The details of wall bracket 4 are shown in FIGS. 5 and 6. Wall bracket 4, likewise, has a main body portion 36 and a locking means 38. Main body portion 36 of wall bracket 4 further incorporates a plurality of nailing slots 40 whereby it can be secured to a vertical wall. Locking means 38 is formed by a J-shaped leg 42 and a I-shaped leg 44.

FIGS. 7 and 8 show the composite removable roof flashing cover system of this invention as assembled to a vertical wall section 46 of a structure.

As can be seen, J-shaped channel 2 is secured to base 46 via nails 48. Further, wall bracket 4 is secured to wall 46 with nails 48. The distance between the bottom edge of J-channel 2 and the top edge of wall bracket 4 can be varied depending on the particular application. Once J-channel 2 and wall bracket 4 are secured in place, face panel 6 is snapped in place to bridge the distance between J-channel 2 and wall bracket 4. The upper terminal end 30 of main body portion 28 is engaged by locking means 12 of J-channel 2. The terminal end 30 is provided with a crimp 31 to assist in the engagement with locking means 12. The bottom edge 32 of main body portion 28 is engaged by the J and L shaped legs of wall bracket 4. Once face panel 6 is in place, sealing flange 34 engages roof line 50. The terminal end of siding panel 39 is secured in J-channel 2 as illustrated.

If it is necessary to reroof a structure on which this invention has been utilized, the roofer first removers face plate 6. Upon removal of face panel 6, wall bracket 4 is full exposed and easily removed. With the removal of wall bracket 4, the new roof can be easily reflashed. Upon installation of the new roof and reflashing, face panel 6 is then replaced. This whole operation is accomplished without disturbing the siding 5, the terminal ends of which remain secured in J-channel 2.

FIG. 9 provides further details on the means whereby end 30 of face plate 6 is secured in locking means 12. As can be seen, end 30 can be further provided with a crimp 31 to facilitate the engagement of end 30 of face plate 6 into locking means 12.

Figure 11:
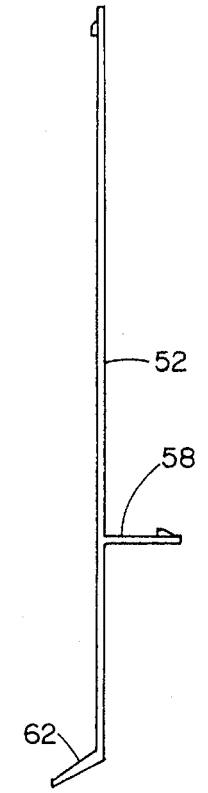
FIG. 10 and 11 are end view showing alternate embodiments for face plate structures.
Figure 10:
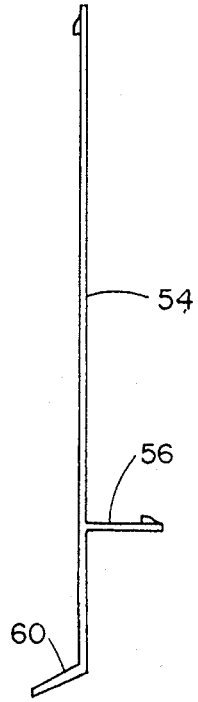

As is illustrated in FIGS. 10 and 11, the face plates for use with this invention can assume alternate embodiments. In the embodiments as illustrated in these Figures, removable face panels 52 and 54 can have varying distances between locking flanges 56 and 58 and sealing flanges 60 and 62.

If during the life of the siding there is a change in roof line 50, for example as a result of reroofing, the roofer need only to replace the removable face panel 6 with another face panel in order to achieve a new seal with the roof line and an aesthetically pleasing installation of a new roof with no gaps or spaces between the new roof and the siding. Further, as described above, reflashing may likewise be effected.

Figure 13:
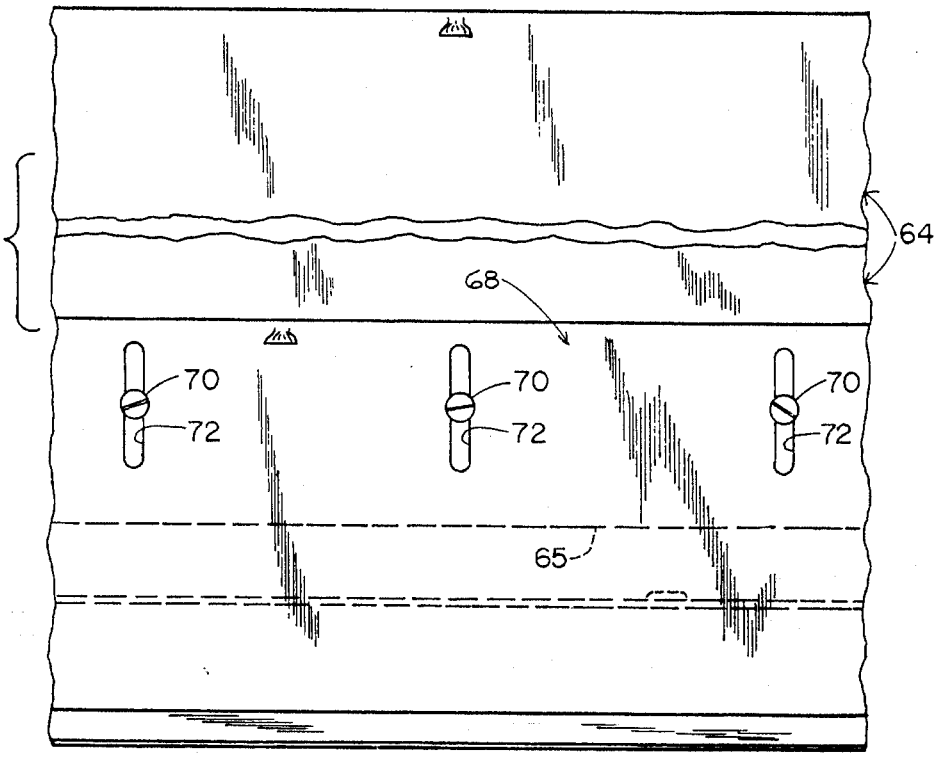
FIG. 13 is a side view showing an alternate embodiment for an adjustable face plate as can be used in this invention.
Figure 12:
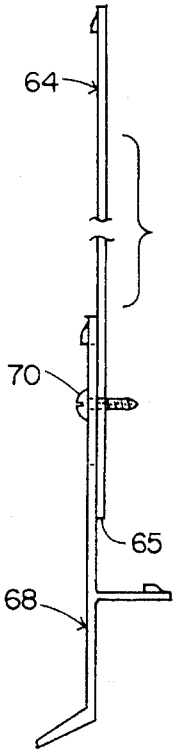
FIG. 12 is an end view showing an alternate embodiment for an adjustable face plate as can be used in the invention.

FIGS. 12 and 13 further illustrate an adjustable face plate 64 which can be used in the subject invention. This embodiment is advantages as it is possible to fill any size gap between the roof line and the J-channel so long as the gap is within the range of adjustability for adjustable face plate 64.

In adjustable face plate 64, the lower end 65 of the main body portion 66 does not abut the roof line. Affixed to lower end 65 is a second adjustment plate 68 which is secured to lower end 65 via a plurality of screws 70. Screws 70 pass through elongated slots 72 which are integral with adjustment plate 68. As can be seen, the overall length of adjustable plate 64 can be varied by moving second adjustment plate 68 up and down and then securing screws 70.

While J-channel 2 is illustrated in the shape of a J, it is understood by one skilled in the art, that this channel can assume other configurations. The essential feature of this component is that it must incorporate means for receiving the terminal ends of the siding which is attached to the building. Alternate embodiments can include L-channels, etc.

It is to be understood that the above description and drawings are illustrative only since equivalent structural elements could be used without departing from the invention, the scope of which is to be limited by the following claims.

What is claimed is:

1. A removable roof flashing cover system comprising:

a recipient surface having a vertical wall and an angled roof therebeneath with a juncture line therebetween, the vertical wall having siding secured thereto at a fixed distance above the juncture line, the angled roof having roofing material thereon at a thickness;

a channel having an interior region positioned on the wall interior of the siding and an intermediate region positioned beneath the siding and an exterior region positioned exterior of the siding, the exterior region being formed with an upper receptor slot, and the interior region having upper attachment means securing the channel with respect to the wall and the siding at a location a fixed distance above the juncture line;

a wall bracket having an upper region positioned on the wall and a lower region positioned above the roofing material, the lower region being formed with a lower receptor slot, and with second attachment means securing the wall bracket to the wall spaced beneath the channel; and a removable face panel having a bottom edge received in the lower receptor slot and a top edge received in the upper receptor slot to cover the space between the channel and the roof.

2. The removable roof flashing cover system of claim 1 wherein the wall bracket and the channel incorporate means for receiving and locking planar edges of the face panel.

3. The removable roof flashing cover system of claim 2 wherein the face panel further incorporates a sealing flange which is located approximate the lower edge of the face panel and said sealing flange is adapted to engage an adjacent roof surface.

4. The removable roof flashing cover system of claim 2 wherein said channel is J-shaped and said wall bracket incorporates means for attachment to a vertical wall section.

5. The removable roof flashing cover system of claim 2 wherein the byte portion of said channel is sloped downwardly away from the vertical wall of the structure.

6. The removable roof flashing cover system of claim 1 wherein the outer edge of channel further incorporates a U shaped channel which is adapted to receive and lock the upper edge of the face panel.

7. The removable roof flashing cover system of claim 6 wherein the outer side of the channel further incorporates a reverse bend portion which is adapted to engage the upper terminal edge of the face panel.

8. The removable roof flashing cover system of claim 7 wherein the face panel further incorporates a sealing flange which is located approximate the lower terminal edge of the face panel and said sealing flange is adapted to engage an adjacent roof surface.

9. The removable roof flashing cover system of claim 6 wherein the face panel further incorporates a sealing flange which is located approximate the lower edge of the face panel and said sealing flange is adapted to engage an adjacent roof surface.

10. The removable roof flashing cover system of claim 6 wherein said channel is J-shaped and said wall bracket incorporates means for attachment to a vertical wall section.

11. The removable roof flashing cover system of claim 6 wherein the byte portion of said channel is sloped downwardly away from the vertical wall of the structure.

12. The removable roof flashing cover system of claim 6 wherein the locking lower edge of the wall bracket incorporates two legs which are at right angles to the wall bracket, wherein said legs define a locking means which is adapted to receive a locking flange which is integral with the face panel.

13. The removable roof flashing cover system of claim 12 wherein the face panel further incorporates a sealing flange which is located approximate the lower terminal edge of the face panel and said sealing flange is adapted to engage an adjacent roof surface.

14. The removable roof flashing cover system of claim 12 wherein said channel is J-shaped and said wall bracket incorporates means for attachment to a vertical wall section.

15. The removable roof flashing cover system of claim 12 wherein at least one of the legs which are at right angles to the main portion of the wall bracket incorporates a J-shaped terminal end, the terminal end of which is disposed towards the main body portion.

16. The removable roof flashing cover system of claim 15 wherein the face panel further incorporates a sealing flange which is located approximate the lower terminal edge of the face panel and said sealing flange is adapted to engage an adjacent roof surface.

17. The removable roof flashing cover system of claim 15 wherein said channel is J-shaped and said wall bracket incorporates means for attachment to a vertical wall section.

18. The removable roof flashing cover system of claim 15 wherein said locking flange which is integral with the face panel further incorporates a barb which is adapted to engage at least one of said wall bracket locking legs.

19. The removable roof flashing system of claim 18 wherein the face panel further incorporates a sealing flange which is located approximate the lower terminal edge of the face panel and said sealing flange is adapted to engage an adjacent roof surface.

20. The removable roof flashing cover system of claim 1 wherein the face panel further incorporates a sealing flange which is located approximate the lower terminal edge of the face panel and said sealing flange is adapted to engage an adjacent roof surface.

21. The removable roof flashing cover system of claim 20 wherein the byte portion of said channel is sloped downwardly away from the vertical wall of the structure.

22. The removable roof flashing cover system of claim 1 wherein said channel is J-shaped and said wall bracket incorporates means for attachment to a vertical wall section.

23. The removable roof flashing cover system of claim 22 wherein the byte portion of said channel is sloped downwardly away from the vertical wall of the structure.

24. The removable roof flashing cover system of claim 1 wherein the face panel incorporates means whereby its height may be adjusted.

25. The removable roof flashing cover system of claim 24 wherein the byte portion of said channel is sloped downwardly away from the vertical wall of the structure.

26. The removable roof flashing cover system of claim 1 wherein the byte portion of said channel is sloped downwardly away from the vertical wall of the structure.

27. The removable roof flashing cover system of claim 26 wherein the byte portion of said channel is provided with a plurality of apertures which will allow moisture to egress from said channel and a locking means which is adapted to secure the upper edge of said face panel being positioned between said apertures and the structure to which said channel is attached.

* * * * *